US006262622B1

(12) United States Patent
Lee et al.

(10) Patent No.: US 6,262,622 B1
(45) Date of Patent: Jul. 17, 2001

(54) BREAKDOWN-FREE HIGH VOLTAGE INPUT CIRCUITRY

(75) Inventors: Peter Wung Lee, Saratoga; Fu-Chang Hsu, San Jose; Hsing-Ya Tsao, Santa Clara; Vei-Han Chan; Hung-Sheng Chen, both of San Jose, all of CA (US)

(73) Assignee: Aplus Flash Technology, Inc., San Jose, CA (US)

( * ) Notice: Subject to any disclaimer, the term of this patent is extended or adjusted under 35 U.S.C. 154(b) by 0 days.

(21) Appl. No.: 09/479,649

(22) Filed: Jan. 8, 2000

(51) Int. Cl.[7] ..... G05F 3/02
(52) U.S. Cl. ..... 327/543; 327/534; 327/538
(58) Field of Search ..... 327/77, 78, 80, 327/81, 87, 535, 536

(56) References Cited

U.S. PATENT DOCUMENTS 6,016,072 * 1/2000 Ternullo et al. ..... 327/535
6,075,404 * 6/2000 Shindoh et al. ..... 327/537
6,104,234 * 8/2000 Shin et al. ..... 327/535

* cited by examiner

*Primary Examiner*—Terry D. Cunningham

(57) ABSTRACT

A high voltage input circuit includes a triple-well NMOS for reducing the voltage stress across its drain junction for preventing it from breakdown. The triple-well NMOS is fabricated in a P-well formed in a deep N-well on a P-substrate. The P-well is coupled to a power supply voltage by a P-well voltage control device to reduce the voltage difference across the drain junction. A low voltage signal input circuit portion is also added to the high voltage input circuit to allow a high voltage input pin to receive other signal and reduce the total pin count of an integrated circuit. A dual-input buffer such as NAND gate instead of an inverter is used in the low voltage signal input circuit for reducing the voltage stress to the devices in the low voltage signal input circuit.

15 Claims, 3 Drawing Sheets

BREAKDOWN-FREE HIGH VOLTAGE INPUT CIRCUITRY

FIELD OF INVENTION

This invention relates to a high voltage input circuit, and more specifically to a high voltage input circuit having reduced junction and gate voltage stress to allow the input operating voltage higher than the limit of the breakdown voltage on its input devices.

BACKGROUND OF INVENTION

Many of today's non-volatile semiconductor integrated circuit chips have one or more pins designed to receive voltages higher than their device breakdown voltages from external sources. Most of these externally supplied high voltages are around 12V that are higher than today's device breakdown voltage of 10V. For reliability concern, the circuitry and devices that receive the higher voltages must be specially handled to prevent the input devices from breakdown caused by the higher voltage stress on either a junction or gate. Therefore, higher voltage breakdown-free input circuitry is a very important feature for semiconductor integrated circuit chips. The higher voltage, generally referred to as VPP, is defined as an external voltage level higher than the power supply voltage VDD and the breakdown voltage of the devices of the chip. The higher voltage is usually provided by an external source such as a programmer device or, if available, from the system where the chip is mounted.

High voltage input circuitry has been widely used in many different applications. However, allowing an input voltage higher than the breakdown voltage of a device is always a concern to the device's reliability. One common practice is to limit the device life cycles and operating hours. A popular use of a high voltage input is for the purpose of forcing an integrated circuit chip to enter special test modes. A high voltage detector is normally built in the chip. By applying a high voltage to the high voltage input pin(s), the detector detects the high voltage and sends a signal to a state machine which allows the chip to enter the pre-designed modes.

Therefore, the design and process engineers can use this feature to access the test modes for debugging or engineering characterization. In addition, the application engineers can use this feature to access their specified test modes for production test. Because the chip receives only low voltage inputs, i.e. Vdd, during its normal operation, this feature effectively prevents customers or other unauthorized persons from accidentally entering the test modes that trigger undesired operations of the chip as well as the system.

Another common application of the high voltage input is in the field of electrically-programmable non-volatile memories. Almost all electrically-programmable non-volatile memories, including EPROM, EEPROM and Flash memory, require high voltages to erase data from or write data to the memory cells. For example, an EPROM (Electrically Programmable Read Only Memory) requires applying approximately 12 to 13 volts to the gate, and 5 to 6 volts to the drain of the memory cell transistor to program a '1' data into the cell.

Due to the requirement of high voltage sources, the process of programming memory data is typically done in a manufacturer's facility. Before the chip is shipped to customers, the old data (if there is any) of the entire memory are erased at one time by exposing the chip under UV light through a crystal window on the package. Then, the new data of the entire memory are programmed by an external device. During this operation, an external programmer device supplies the required high voltages and timing control signals.

Unlike EPROM, the mechanism of memory erasure in the later developed EEPROM and flash memories is significant improved. Both EEPROM and flash memories can be erased electrically without being exposed under UV light, thus eliminating the crystal window required for UV exposure. Manufacturing and reprogramming cost is greatly reduced. However, both memories require high voltages to erase memory data electrically.

There are various EEPROM and flash memory technologies in the market today. Technologies for flash memories are widely researched and developed. Most of them target applications that have different erasing or programming requirements and schemes. The details for the operation of EEPROM and flash memory are known to persons skilled in the art and will not be discussed here. In essence, most of the erasing operations of existing EEPROM and flash memories are based on same fundamentals that require a high voltage to be applied to one or more of the cell transistor's electrical poles. Compared with the high voltage detector circuit used for entering test modes only, the high voltage input circuit for non-volatile memories has more demanding input specifications. It generally requires higher current driving capability for providing the internal memory cells with sufficient current to erase and program the memory cells.

As the fabrication process of non-volatile memories continue to migrate towards the reduction of device oxide thickness and junction depth for speed enhancement reason, the high voltage input circuitry design has become an important and tough challenge. The junction depth and well spacing of these devices also continue to shrink for more compact layout and higher integration. These technologies result in lower breakdown voltage in the high voltage input circuitry of a device. The lower breakdown voltage can no longer withstand voltages as high as 12 to 13 volts that are provided by external voltage sources conventionally.

To cope with the lower breakdown voltage in the newer device, the industry has to replace the existing programmers as well as the systems so that a relatively lower high voltage can be provided. However, the high replacement cost usually forces the manufacturer of a device chip to keep two technologies at the same time, i.e., using the old technology for the high voltage input circuit that requires thicker gate oxide and deeper junction depth while using the newer technology for the rest of the low-voltage device. Therefore, it would be very advantageous for the industry if the newer devices could be made capable of receiving voltages higher than their breakdown voltage as used in the conventional technology.

As shown in FIGS. 1 and 2, two types of high voltage input circuits have been disclosed in U.S. Pat. No. 5,420,798. The circuit shown in FIG. 1 uses a PMOS (P1) for receiving and passing a high voltage VPP. The gate of the PMOS is connected to VDD. When the high voltage input is not applied, typically the input pin is connected to VDD. This turns off the PMOS and the output of the inverter is at a high state indicating a normal mode.

When the high voltage input VPP is applied to the input pin, the PMOS is turned on because the high voltage is greater than the sum of VDD and the threshold voltage VTP of the PMOS. The voltage at the input node of the inverter is determined by the pull-up resistor R1, the PMOS turn-on resistance, and the pull-down resistor R2. By properly selecting these resistors, the input node is set to a relatively high level that causes the output of the inverter to be low. Consequently, the device chip is put into a specified test mode by the low output signal.

FIG. 2 shows another high voltage input circuitry. The basic structure of the PMOS as well as the resistors R1 and R2 as shown in FIGS. 1 and 2 are identical. One or more NMOS (N1) each having its gate and drain connected to form a diode are added between the resister R1 and the PMOS in series. As the high voltage passes each diode, it drops approximately a threshold voltage VTN of an NMOS. Therefore, these NMOS diodes in series reduce the voltage applied to the source of the PMOS, thus reducing the stress of the PMOS and preventing it from breakdown. In addition to these two circuits, there are also other prior arts for the high voltage input circuits. However, almost all the prior arts have very similar concept as these two. Examples can be found in U.S. Pat. Nos. 5,420,798 and 5,493,244.

Comparing the two prior art circuits of FIGS. 1 and 2, the one shown in FIG. 1 is less preferred because it has a significant drawback that the high voltage pin must be dedicated to the high voltage input only. That is due to the fact that the circuit uses a PMOS to receive the high voltage input, thus the N-well of the PMOS must be also connected to the same high voltage input pin in order to avoid a P-N junction forward current. When a high voltage is not applied, the voltage at the input pin is typically VDD. Dedicating one pin simply to the test mode is not economical.

Moreover, for many applications that require multiple high voltage input pins, the pin count dramatically increases. It is highly desirable that the high voltage input pins be used as other low voltage pins such as address input pins when they are not applied with a high voltage. However, because the N-well of the PMOS is directly connected to a high voltage input pin, using this pin as a normal input pin or output pin causes the N-well to be switched between VDD and ground. It may raise a serious latch-up concern. As a result, the prior art shown in FIG. 1 is not very practical.

On the other hand, the prior art shown in FIG. 2 does not have such a latch-up concern because no well is directly connected to the high voltage input pin. Thus, the high voltage input pin can be used for other signals. However, there are cases that a significant breakdown problem of the high voltage input circuit may occur to this circuitry. Considering the circuit shown in FIG. 2, when applied with a high voltage, the maximum high voltage stress is put on the drain junction of the NMOS diode (N1) instead of the PMOS (P1). Because the NMOS is located on the P-substrate that is always connected to ground, the drain junction experiences VPP to ground voltage difference which may cause junction and gate-oxide breakdown to occur if VPP is exceeding the allowed breakdown voltages.

Although the original idea of adding the NMOS diode is to protect the PMOS from breakdown, unfortunately it does not protect the NMOS diode itself. All known prior arts do not seem to handle this junction and gate-oxide breakdown problems with care. The NMOS is simply disposed in the P-substrate without any protection. As a result, the breakdown of the NMOS becomes a killing factor for the high voltage input circuitry.

SUMMARY OF THE INVENTION

The present invention has been made to overcome the deficiency of a conventional high voltage input circuit whose devices can only have limited life cycles if they operate at voltages higher than the breakdown voltage. The primary object of the invention is to provide a high voltage input circuit having a protection circuit for reducing the voltage stress across the drain junction and gate-oxide of its devices. By adding a triple-well NMOS with a P-well voltage control device to a conventional high voltage input circuit, the voltage difference across the drain junction is greatly reduced, thus preventing the junction from breakdown.

Unlike the prior art in which an NMOS is made on a P-substrate, the triple-well NMOS is instead fabricated in a P-well that is formed in a deep N-well on a P-substrate. The P-well voltage control device adjusts the voltage being applied to the P-well when a high voltage is received in the high voltage input circuit. The P-well voltage can be adjusted to a positive power supply voltage to reduce the voltage difference across its high-voltage drain junction with respect to this P-well. For applications using an extremely low power supply voltage, the P-well voltage can also be adjusted to an intermediate voltage level between the high voltage and the power supply voltage. This intermediate voltage level can be derived from the high voltage by other circuits.

Another object of the invention is to provide a high voltage input circuit that does not increase the total pin count of an integrated circuit. According to the invention, a low voltage signal input circuit is added to the high voltage input circuit for receiving a low voltage signal. When a high voltage input is not applied to the integrated circuit, the high voltage input pin can be used to receive other signals such as address or I/O data.

It is also an object of the invention to provide protection for the low voltage signal input circuit. In the present invention, the low voltage signal input circuit portion comprises a dual-input buffer such as a NAND gate. By using such a buffer, the low voltage signal input circuit portion of this invention also has much lower voltage stress when an input is coupled to the high voltage. When a high voltage is not applied, the NAND gate is configured as an inverter. When a high voltage is applied, the channels of both input PMOS and NMOS of the NAND gate are charged to a power supply voltage level. Therefore, the high voltage stress on the devices' gate with respect to the ground channel has been replaced by VDD channel, thus the stress on the low voltage signal input circuit portion is greatly reduced.

The present invention will be better understood from the following description of preferred embodiments with reference to the accompanied drawings.

DETAILED DESCRIPTION OF THE PREFERRED EMBODIMENTS

Figure 2:
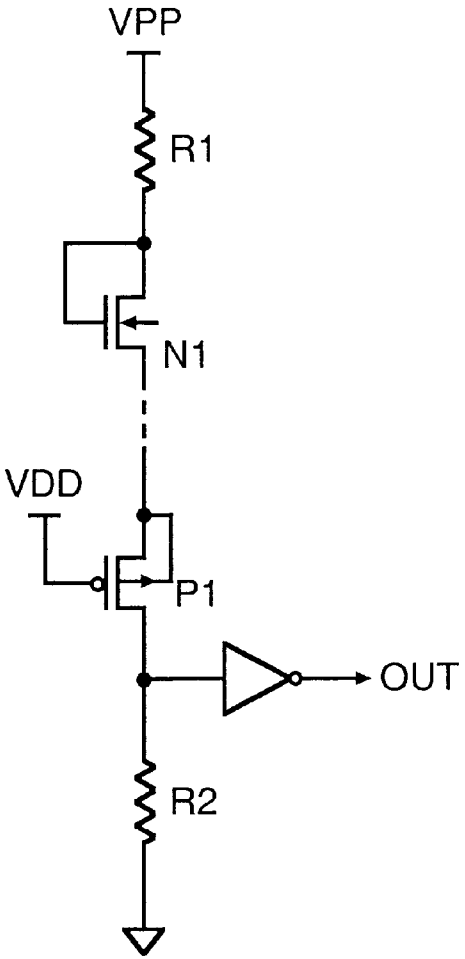
FIG.2 (PRIOR ART)
FIG. 2 shows another conventional high voltage input circuit in which an NMOS on a P-substrate is added to reduce the voltage difference across the PMOS in the circuit.
Figure 1:
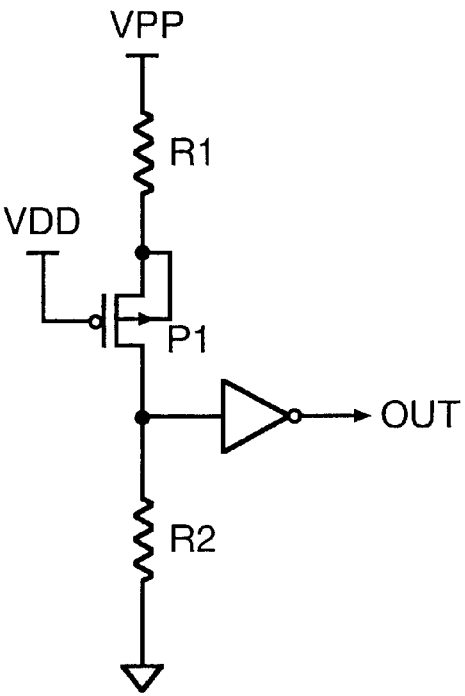
FIG.1 (PRIOR ART)
FIG. 1 shows a conventional high voltage input circuit.
Figure 3:
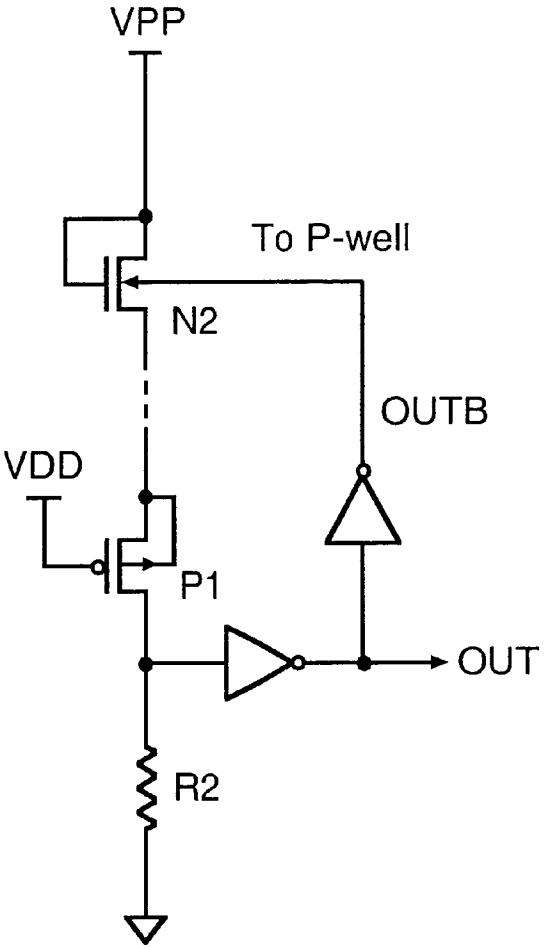
FIG. 3 shows the high voltage input circuit of this invention in which a triple-well NMOS fabricated in a P-Well formed in a deep N-well is used to reduce the voltage stress across the drain junction and gate-oxide of the NMOS.

The present invention discloses a novel circuitry that has several features to protect the device from the high voltage stress and allows a high voltage input pin to be used for other low voltage signal when an external high voltage is not applied. The high voltage detector circuitry of this invention is shown in FIG. 3. As described earlier, the maximum stress occurs at the drain junction of the NMOS (N1) in the conventional circuit of FIG. 2, and the breakdown problem is mostly caused by the fact that the NMOS is disposed in the P-substrate. To solve this problem, this invention uses a 'triple-well' NMOS (N2) as shown in FIG. 3 to replace the conventional NMOS (N1) that is located in the P-substrate.

According to the invention, the high voltage detector comprises a PMOS (P1), a triple-well NMOS (N2), an inverter connected to the drain of the PMOS (P1) and a P-well voltage control device for coupling the P-well of the NMOS (N2) to the output of the inverter. In a preferred embodiment as shown in FIG. 3, an inverter is used as the P-well voltage control device.

Figure 4:
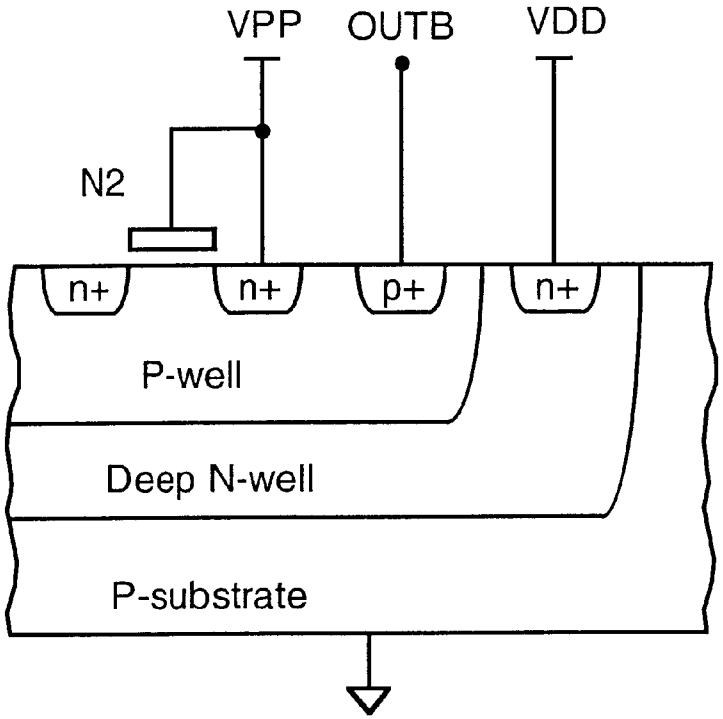
FIG. 4 shows a cross-sectional view of the device structure of the triple-well NMOS fabricated in a P-well formed in a deep N-well on a P-substrate according to the present invention.

With reference to FIG. 4, the device profile of the triple-well NMOS (N2) of the present invention is shown. The triple-well NMOS (N2) has an isolated P-well which is disposed within a deep N-well in order to isolate the P-well from the P-substrate. Thus, different potential can be applied to the P-well and P-substrate. For the circuit shown in FIG. 3, the potential of the P-well of this NMOS (N2) is determined by the output of the high voltage detector.

The isolation of the P-well from the P-substrate provides a couple of advantages. First of all, when the high voltage input is not applied, the output signal of the high voltage detector (OUT) is VDD, thus fixing the voltage of the P-well at ground. This allows the high voltage input pin to be also used for other signals such as address-input pin or data I/O pin to save the total pin count. Secondly, when a high voltage is applied, the output of the high voltage detector goes low and the P-well is switched from ground to VDD.

Accordingly, the voltage difference across the drain junction and gate of the NMOS (N2) of the present invention with respect to P-substrate is reduced to VPP-VDD which is much lower than the voltage difference VPP in the prior art. The lower voltage difference significantly reduces the voltage stress on the drain junction of the NMOS (N2). According to experimental results, the voltage stress to the device is greatly reduced and the device life time is increased by two to three orders. Meanwhile, the deep N-well is coupled to VDD and the P-substrate can be connected to ground as usual because of the addition of the deep N-well.

According to the basic structure as illustrated in FIG. 3, several embodiments can be implemented. In one embodiment, only the first NMOS (N2) diode which directly connects to the external high voltage pin is disposed in the P-well located within the deep N-well as shown in FIG. 4, the other NMOS diodes in series can be disposed in P-substrate only. In another embodiment, all the NMOS diodes in series are disposed in the P-well located in the deep N-well.

Considering a special case of using the invention in an extremely low power supply VDD condition, applying VDD to the P-well of the NMOS may not be very effective. Therefore, this invention presents an alternative embodiment that uses a higher P-well voltage. A proper intermediate potential between VDD and VPP is applied to the P-well in this embodiment.

Figure 5:
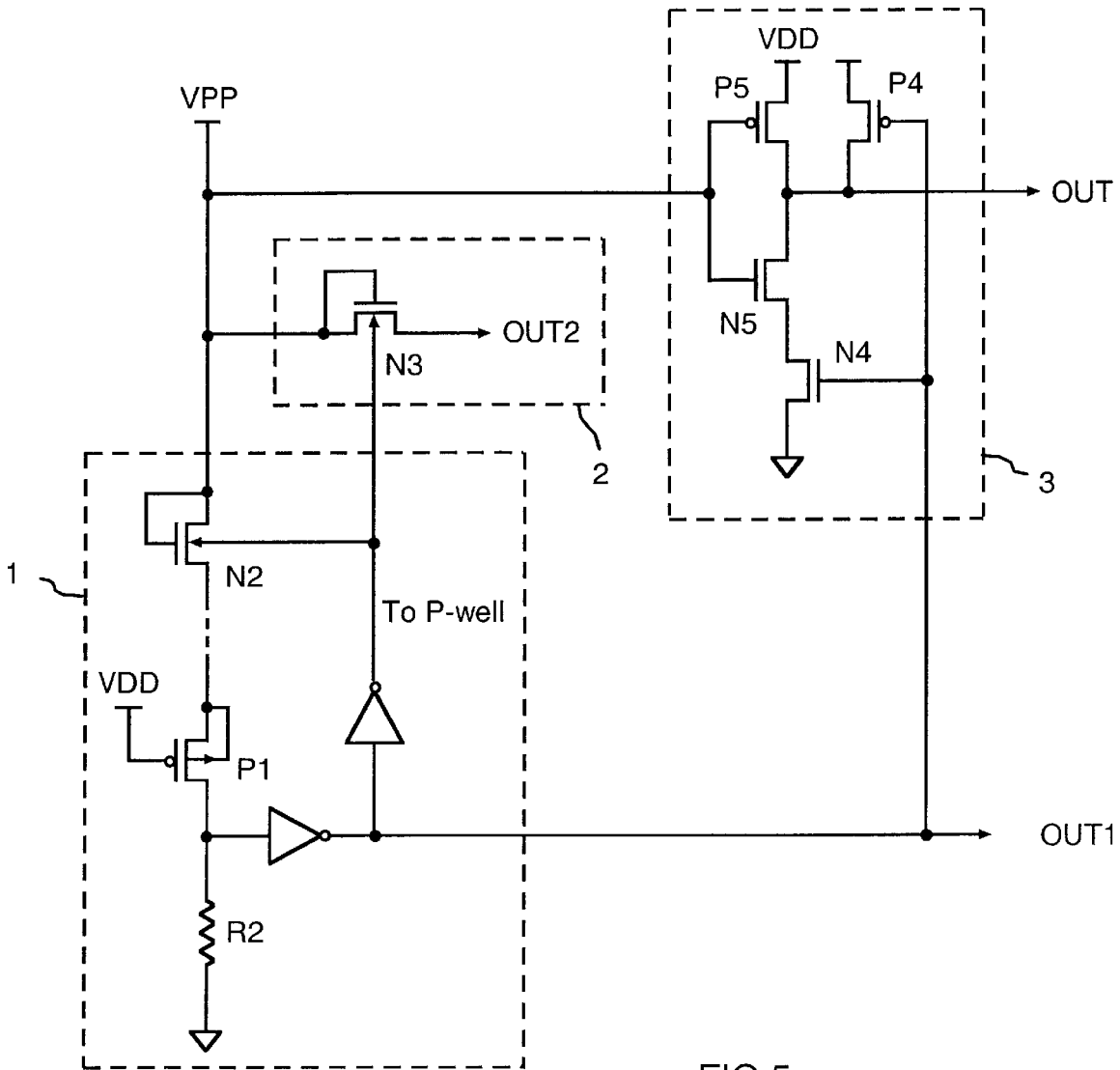
FIG. 5 shows a complete high voltage input circuit including a high voltage detector, a high voltage current pass and a low voltage signal input circuit of NAND gate according to the present invention.

FIG. 5 shows a complete high voltage input circuit of this invention. This circuitry comprises three parts. The first part is a high voltage detector 1 as described in FIG. 3. The second part is a high voltage and high current pass 2 that allows the external high voltage to pass both high voltage and high current to the internal circuits of the chip. As mentioned in the background, it is especially useful for electrically-erasable non-volatile memories. The high voltage current pass 2 is also a triple-well NMOS (N3) similar to the NMOS (N2) used in the high voltage detector. The width of the NMOS (N3) may be made larger to allow more current to pass through. Its P-well is also connected to the P-well of the NMOS (N2) in order to reduce the drain junction and gate stress as described in FIG. 3.

The third part is a low voltage signal input circuit 3 that allows the high voltage input pin to be used for other signal when a high voltage is not applied to the pin. For the application, an inverter buffer is usually used in the prior art for receiving the input low voltage signal. It is important to note that although this low voltage signal input circuit has been overlooked in the prior art, high voltage stress is actually put on the gate oxide of the buffer when a high voltage is applied.

A conventional inverter buffer comprises a PMOS and an NMOS. By ignoring P4 and N4 of the low voltage signal input circuit 3, P5 and N5 would constitute an inverter buffer. Considering an inverter with its gate connected to a high voltage, the PMOS (P5) of the inverter is turned off and the NMOS (N5) is turned on to pull the output node of the inverter to ground. The gate oxides of the PMOS and NMOS are stressed by the high voltage VPP. If this VPP is higher than the allowed gate-oxide breakdown voltage, it results in reliability problem.

To solve this problem, the invention uses a dual-input input buffer as shown in FIG. 5 rather than the conventional inverter for the low voltage signal input circuit 3. One of the input of the input buffer comes from the high voltage input pin and the other input comes from the output of the high voltage detector (OUT1). When a high voltage is not applied to the pin, the signal OUT1 is set at VDD to configure the input buffer as an inverter. When a high voltage is applied, the signal OUT1 is switched to ground to allow the PMOS (P4) to charge the output of the input buffer to VDD.

In addition to a dual-input buffer comprising PMOS (P5), NMOS (N5) and PMOS (P4), a ground isolation device is used to isolate the buffer from ground for reducing the voltage stress on the gate-oxides of the devices in the buffer. As shown in FIG. 5, the NMOS (N4) isolates the NMOS (N5) from ground because the gate of NMOS (N4) is connected to the signal OUT1. This significantly reduces the voltage stress on the gate-oxide of PMOS (P5) and NMOS (N5) from VPP to VPP-VDD.

In a preferred embodiment, the invention uses an NAND gate as shown in FIG. 5 rather than the conventional inverter for the low voltage signal input circuit 3. One of the input of the NAND gate comes from the high voltage input pin and the other input comes from the output of the high voltage detector (OUT1). When a high voltage is not applied to the pin, the signal OUT1 is set at VDD to configure the NAND gate as an inverter. When a high voltage is applied, the signal OUT1 is switched to ground to allow the PMOS (P4) to charge the output of the NAND gate to VDD. This significantly reduces the voltage stress on the gate-oxide of PMOS (P5) and NMOS (N5) from VPP to VPP-VDD.

What is claimed is:

1. A high voltage input circuit comprising:

a PMOS having a gate coupled to a bias voltage, a drain, and a source;

a resistor having a first end connected to the drain of said PMOS and a second end connected to ground;

a first inverter having an input connected to the drain of said PMOS, and an output;

a first NMOS connected in series with said PMOS, said first NMOS having a gate, a drain, a source and a P-well, the drain and gate of said first NMOS being connected together to a high voltage input terminal for receiving a high voltage; and a P-well voltage control device having an input connected to the output of said first inverter and an output connected to said P-well of said first NMOS, said P-well voltage control device being an inverter.

2. The high voltage input circuit as claimed in claim 1, wherein said first NMOS includes a gate oxide layer, and said P-well voltage control device controls the voltage being applied to said P-well for reducing the voltage difference across said drain and P-well of said first NMOS and the voltage difference across said gate oxide layer when a high voltage is received by said high voltage input terminal.

3. A high voltage input circuit comprising:

a PMOS having a gate coupled to a bias voltage, a drain, and a source;

a resistor having a first end connected to the drain of said PMOS and a second end connected to ground;

a first inverter having an input connected to the drain of said PMOS, and an output;

a first NMOS connected in series with said PMOS, said first NMOS being a triple well NMOS having a gate, a drain, a source and a gate oxide layer fabricated in a P-well formed in a deep N-well on a P-substrate, said drain and gate of said first NMOS being connected together to a high voltage input terminal for receiving a high voltage; and a P-well voltage control device having an input connected to the output of said first inverter and an output connected to said P-well of said first NMOS.

4. The high voltage input circuit as claimed in claim 3, further comprising at least a second NMOS being disposed in series between said first NMOS and said PMOS, said second NMOS having a drain and a gate connected together.

5. The high voltage input circuit as claimed in claim 4, wherein said said second NMOS is fabricated in said P-substrate.

6. The high voltage input circuit as claimed in claim 4, wherein said second NMOS is fabricated in a P-well formed in a deep N-well in said P-substrate.

7. A high voltage input circuit comprising:

a PMOS having a gate coupled to a bias voltage, a drain, and a source;

a resistor having a first end connected to the drain of said PMOS and a second end connected to ground;

a first inverter having an input connected to the drain of said PMOS, and an output;

a first NMOS connected in series with said PMOS, said first NMOS having a gate, a drain, a source and a P-well, the drain and gate of said first NMOS being connected together to a high voltage input terminal for receiving a high voltage;

a P-well voltage control device having an input connected to the output of said first inverter and an output connected to said P-well of said first NMOS; and an input buffer having a first input connected to said high voltage input terminal, a second input connected to the output of said first inverter, a buffer output, and a device terminal connected to a ground isolation device, said device terminal being isolated from ground when a high voltage is received by said high voltage input terminal.

8. The high voltage input circuit as claimed in claim 7, said ground isolation device being coupled to the output of said first inverter.

9. The high voltage input circuit as claimed in claim 7, said input buffer being formed by a NAND gate.

10. A high voltage input circuit comprising:

a PMOS having a gate coupled to a bias voltage, a drain, and a source;

a resistor having a first end connected to the drain of said PMOS and a second end connected to ground;

a first inverter having an input connected to the drain of said PMOS, and an output;

a first NMOS connected in series with said PMOS, said first NMOS having a gate, a drain, a source and a P-well, the drain and gate of said first NMOS being connected together to a high voltage input terminal for receiving a high voltage;

a P-well voltage control device having an input connected to the output of said first inverter and an output connected to said P-well of said first NMOS; and a current pass NMOS having a gate and a drain connected together to said high voltage input terminal, a source connected to internal circuits of a chip for providing high current, and a P-well connected to the output of said P-well voltage control device.

11. The high voltage input circuit as claimed in claim 10, wherein said current pass NMOS is a triple well NMOS fabricated in a P-well formed in a deep N-well on a P-substrate.

12. The high voltage input circuit as claimed in claim 10, further comprising a NAND gate having a first input connected to said high voltage input terminal, a second input connected to the output of said first inverter, and an output.

13. The high voltage input circuit as claimed in claim 10, further comprising an input buffer having a first input connected to said high voltage input terminal, a second input connected to the output of said first inverter, a buffer output, and a device terminal connected to a ground isolation device, said device terminal being isolated from ground when a high voltage is received by said high voltage input terminal.

14. The high voltage input circuit as claimed in claim 13, said ground isolation device being coupled to the output of said first inverter.

15. The high voltage input circuit as claimed in claim 13, said input buffer being formed by a NAND gate.

* * * * *